US009634396B2

(12) United States Patent
Yona et al.

(10) Patent No.: US 9,634,396 B2
(45) Date of Patent: Apr. 25, 2017

(54) EXTREMELY LOW-PROFILE ANTENNA

(71) Applicant: GALTRONICS CORPORATION LTD., Tiberias (IL)

(72) Inventors: Haim Yona, Givat Avni (IL); Chen Cohen, Hatzor Haglilit (IL); Yaniv Ziv, Tiberias (IL)

(73) Assignee: GALTRONICS CORPORATION LTD., Tiberias (IL)

( * ) Notice: Subject to any disclaimer, the term of this patent is extended or adjusted under 35 U.S.C. 154(b) by 345 days.

(21) Appl. No.: 14/325,828

(22) Filed: Jul. 8, 2014

(65) Prior Publication Data

US 2015/0015447 A1 Jan. 15, 2015

Related U.S. Application Data

(60) Provisional application No. 61/843,940, filed on Jul. 9, 2013, provisional application No. 61/911,007, filed on Dec. 3, 2013, provisional application No. 61/991,893, filed on May 12, 2014.

(51) Int. Cl.
*H01Q 1/36* (2006.01)
*H01Q 1/48* (2006.01)
*H01Q 9/40* (2006.01)

(52) U.S. Cl.
CPC ..... *H01Q 9/40* (2013.01); *H01Q 1/36* (2013.01); *H01Q 1/48* (2013.01)

(58) Field of Classification Search
CPC ..... H01Q 1/2291; H01Q 1/246; H01Q 1/36; H01Q 1/48; H01Q 5/25; H01Q 5/30; H01Q 5/307; H01Q 5/50; H01Q 9/02; H01Q 9/40; H01Q 9/0407
See application file for complete search history.

(56) References Cited

U.S. PATENT DOCUMENTS 3,076,668 A * 2/1963 Famely ..... F16L 5/027 248/56
4,697,189 A * 9/1987 Ness ..... H01Q 9/0407 343/700 MS
5,506,592 A 4/1996 MacDonald et al.
7,132,993 B2 11/2006 Kuroda et al.
7,245,263 B2 7/2007 Hoshi
7,446,725 B2 * 11/2008 Song ..... H01Q 9/28 343/789
7,973,731 B2 * 7/2011 Parsche ..... H01Q 9/28 343/772
8,184,060 B2 * 5/2012 Du ..... H01Q 21/28 343/773

(Continued)

OTHER PUBLICATIONS

U.S. Appl. No. 61/843,940, filed Jul. 9, 2013.

(Continued)

*Primary Examiner* — Graham Smith
*Assistant Examiner* — Patrick Holecek
(74) *Attorney, Agent, or Firm* — Lorenz & Kopf, LLP.

(57) ABSTRACT

An antenna, including a ground region having a plurality of meandering slots formed therein, a generally conical radiating element supported on the ground region and spaced apart therefrom and a generally flat disk-shaped radiating element disposed between the generally conical radiating element and the ground region, the generally flat disk-shaped radiating element feeding the generally conical radiating element.

16 Claims, 12 Drawing Sheets

(56) References Cited

U.S. PATENT DOCUMENTS

| | | | | |
|---|---|---|---|---|
| 8,184,061 | B2 * | 5/2012 | Sanford | H01Q 21/06 343/773 |
| 8,723,746 | B1 * | 5/2014 | Doane | H01Q 1/48 343/756 |
| 2003/0103008 | A1 * | 6/2003 | Petropoulos | H01Q 1/243 343/702 |
| 2003/0201939 | A1 * | 10/2003 | Reece | H01Q 9/0407 343/700 MS |

OTHER PUBLICATIONS

U.S. Appl. No. 61/991,893, filed May 12, 2014.
U.S. Appl. No. 61/911,007, filed Dec. 3, 2013.
An International Search Report and Written Opinion both dated Apr. 6, 2015, which issued during the prosecution of Applicant's PCT/IL2014/050617.

* cited by examiner

EXTREMELY LOW-PROFILE ANTENNA

REFERENCE TO RELATED APPLICATIONS

Reference is hereby made to U.S. Provisional Patent Application 61/843,940, entitled EXTREMELY LOW-PROFILE ANTENNA, filed Jul. 9, 2013, to U.S. Provisional Patent Application 61/911,007, entitled EXTREMELY LOW-PROFILE ANTENNA WITH CONDUCTIVE HOLDER, filed Dec. 3, 2013, and to U.S. Provisional Patent Application 61/991,893, entitled EXTREMELY LOW-PROFILE ANTENNA, filed May 12, 2014, the disclosures of which are hereby incorporated by reference and priorities of which are hereby claimed pursuant to 37 CPR 1.78(a)(4) and (5)(i).

FIELD OF THE INVENTION

The present invention relates generally to antennas and more particularly to low-profile antennas.

BACKGROUND OF THE INVENTION

Various types of low-profile antennas are known in the art.

SUMMARY OF THE INVENTION

The present invention seeks to provide an improved extremely low-profile multiband antenna.

There is thus provided in accordance with a preferred embodiment of the present invention an antenna, including a ground region having a plurality of meandering slots formed therein, a generally conical radiating element supported on the ground region and spaced apart therefrom and a generally flat disk-shaped radiating element disposed between the generally conical radiating element and the ground region, the generally flat disk-shaped radiating element feeding the generally conical radiating element.

Preferably, the ground region includes generally planar element.

Preferably, the generally conical radiating element includes a base and an apex and is disposed such that the apex is proximal to the ground region and the base is distal therefrom.

Preferably, the generally flat disk-shaped radiating element is disposed between the apex and the ground region.

In accordance with a preferred embodiment of the present invention, the antenna also includes a multiplicity of conductive elements supporting the generally conical radiating element and extending between the generally conical radiating element and the ground region.

Preferably, at least one of the multiplicity of conductive elements forms a galvanic connection between the generally conical radiating element and the ground region.

Additionally, at least one of the multiplicity of conductive elements forms a capacitive connection between the generally conical radiating element and the ground region.

Preferably, the multiplicity of conductive elements emerges from the base of the generally conical radiating element and terminates on the ground region immediately adjacent to the plurality of meandering slots.

In accordance with another preferred embodiment of the present invention, the antenna is fed by a coaxial feed arrangement, the coaxial feed arrangement including an inner core feed element and an outer grounded metallic shield, the inner core feed element extending from the generally flat disk-shaped radiating element through the apex of the generally conical radiating element, the outer grounded metallic shield being connected to the ground region.

Preferably, the inner core feed element is galvanically connected to the generally flat disk-shaped radiating element and to the generally conical radiating element.

In accordance with a further preferred embodiment of the present invention, the antenna also includes a non-conductive holder abutting the ground region and circumferentially disposed about the coaxial feed arrangement.

Preferably, the antenna also includes a non-conductive connector portion including a first segment disposed proximal to the ground region and a second segment partially overlapping with the first segment and disposed distal from the ground region, the non-conductive holder enclosing the first segment and resting on the second segment.

Alternatively, the antenna also includes a conductive holder circumferentially disposed about the coaxial feed arrangement, abutting the ground region and galvanically connected thereto, the conductive holder forming a portion of the ground region.

Preferably, the antenna operates as a multiband antenna, the generally conical radiating element in combination with the ground region and the generally flat disk-shaped radiating element radiating in a low-frequency band and the generally conical radiating element in combination with the generally flat disk-shaped radiating element radiating in a high-frequency band.

Preferably, the low-frequency band lies in a frequency range of 700-960 MHz and the high-frequency band lies in a frequency range of 1710-2700 MHz.

Preferably, a height of the antenna is less than or equal to 25 mm.

Preferably, the antenna also includes wing-like protrusions extending from the base of the generally conical radiating element.

Preferably, a diameter of the generally flat disk-shaped radiating element is between 20 and 25 mm.

Additionally or alternatively, a separation of the generally flat disk-shaped radiating element from the planar ground region is between 3 and 5 mm.

In accordance with yet another preferred embodiment of the present invention, each one of the meandering slots includes a closure formed therein.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
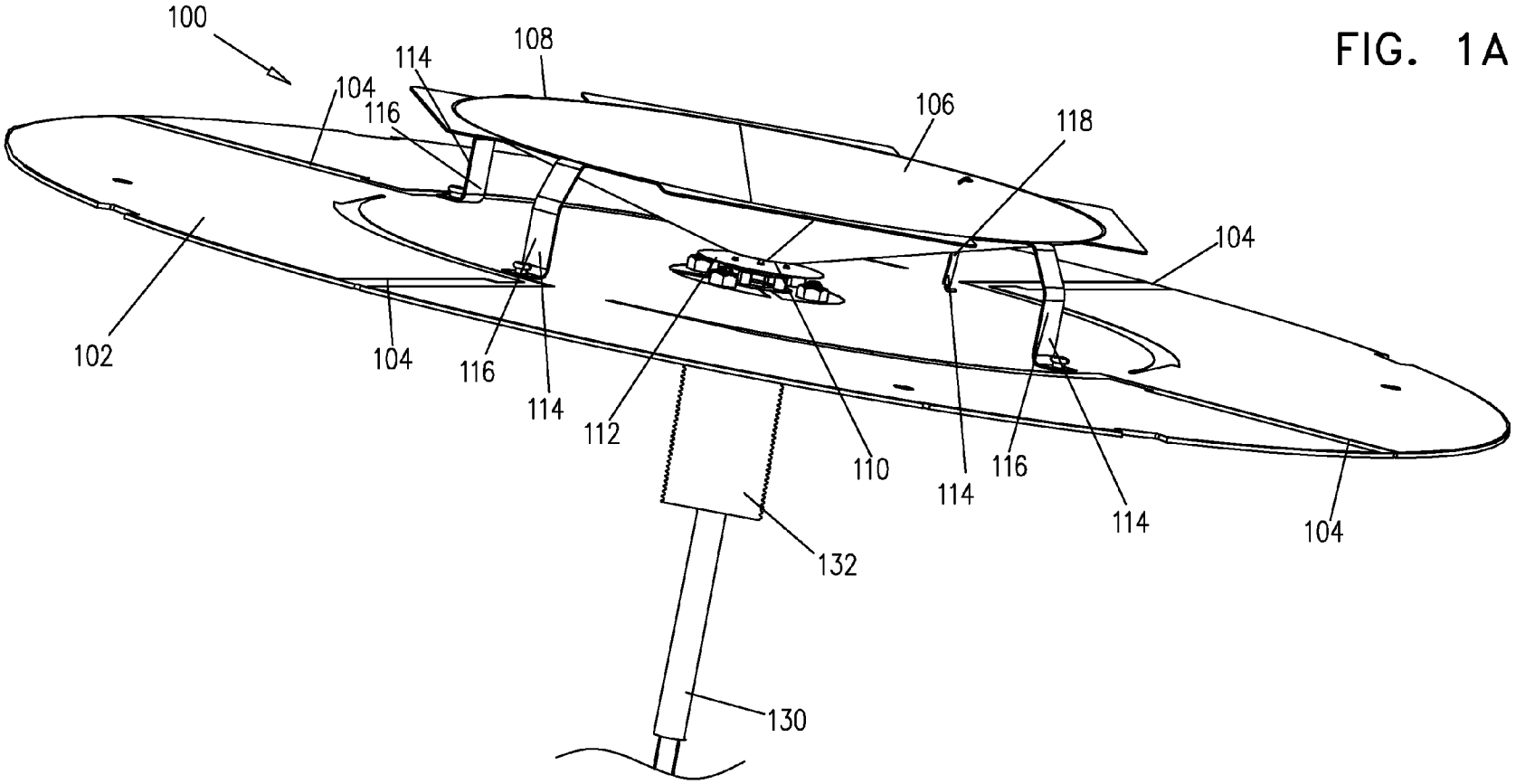
FIGS. 1A, 1B, 1C and 1D are simplified respective perspective, top, side and cross-sectional side view illustrations of an antenna constructed and operative in accordance with a preferred embodiment of the present invention.
Figure 1B:
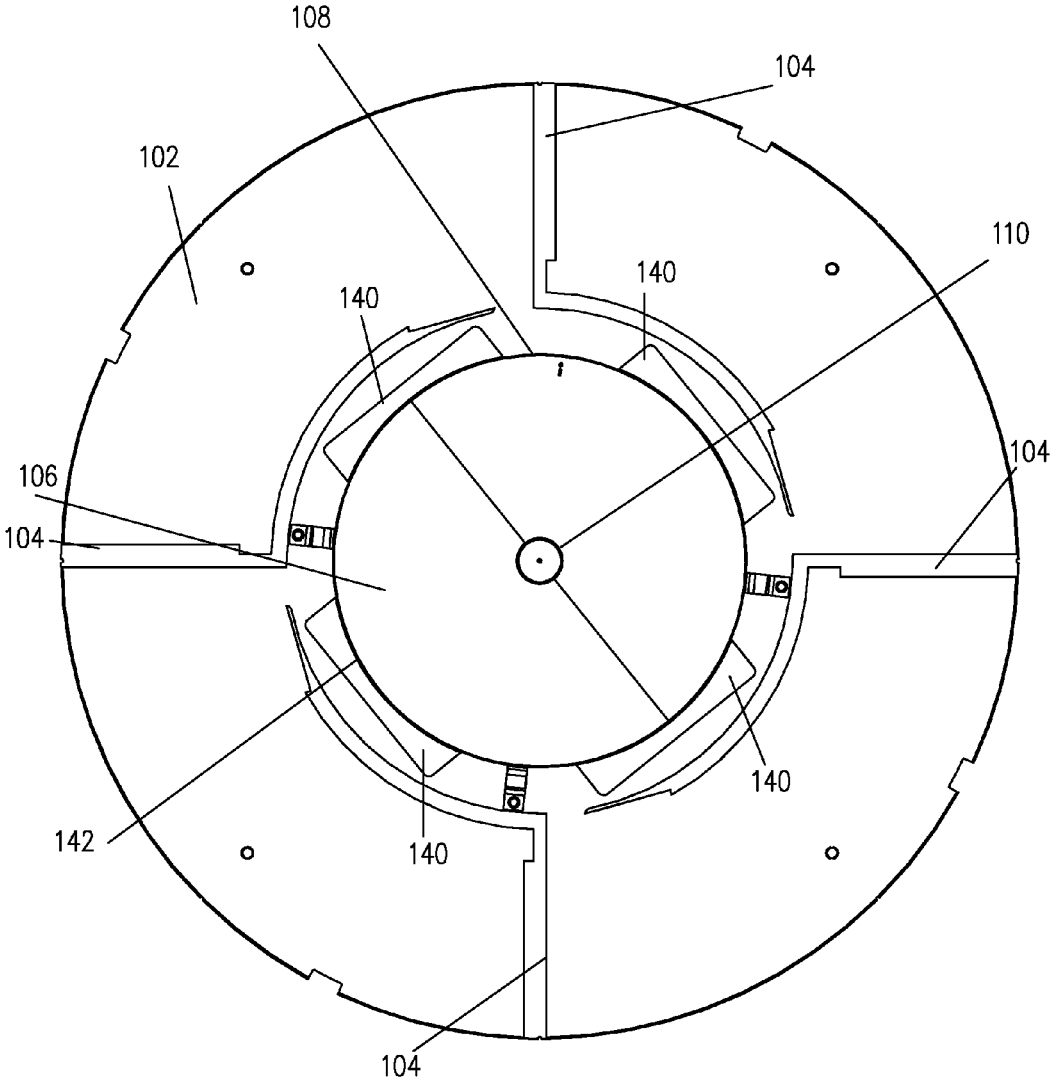
Figure 1C:
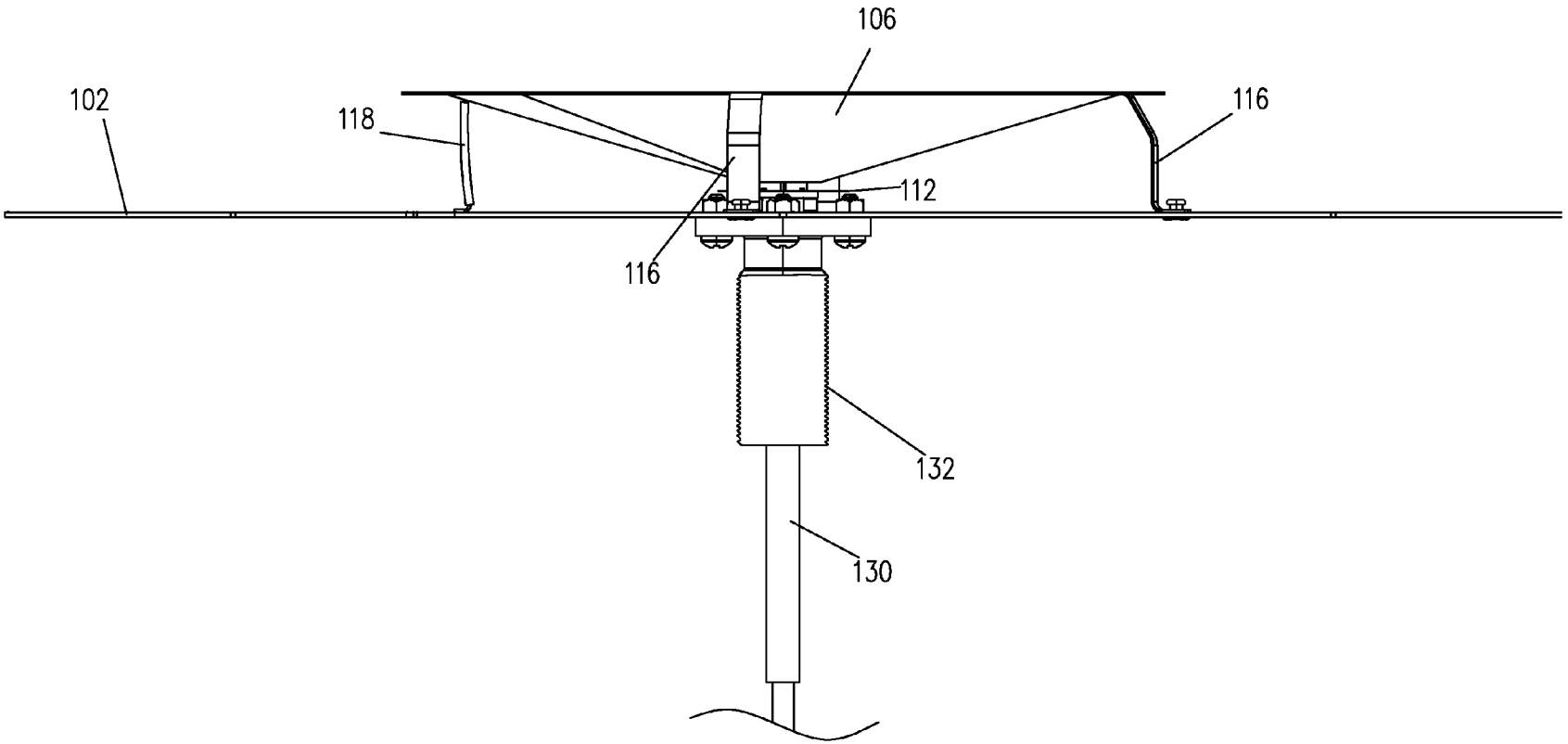

Reference is now made to FIGS. 1A, 1B, 1C and 1D, which are simplified respective perspective, top, side and cross-sectional side view illustrations of an antenna constructed and operative in accordance with a preferred embodiment of the present invention.

As seen in FIGS. 1A-1D, there is provided an antenna 100. Antenna 100 preferably includes a generally planar ground region 102 having a plurality of meandering slots 104 formed therein. A generally conical radiating element 106 is preferably supported on ground region 102 and spaced apart therefrom. Conical radiating element 106 preferably has a base 108 and an apex 110 and is preferably disposed in spaced relation to ground region 102 such that apex 110 is proximal to ground region 102 and base 108 is distal therefrom, as seen most clearly in FIGS. 1A and 1C.

A generally flat disk-shaped radiating element 112 is preferably disposed between apex 110 of conical radiating element 106 and ground region 102. Disk-shaped radiating element 112 preferably has a dual-function in antenna 100, both as a feed element, for feeding conical radiating element 106 and as a radiating element in its own right, as will be detailed henceforth. The generally flat configuration of disk-shaped radiating element 112 allows disk-shaped radiating element 112 to perform its feeding and radiating functions with minimal contribution to a height of antenna 100, hence rendering antenna 100 extremely compact.

The compact, low-profile configuration of antenna 100 is further facilitated by way of the preferable inclusion therein of a multiplicity of conductive elements 114, preferably supporting conical radiating element 106 on ground region 102 and extending between conical radiating element 106 and ground region 102. Conductive elements 114 may galvanically connect conical radiating element 106 to ground region 102. Conductive elements 114 may emerge from base 108 and may terminate at a location on ground region 102 immediately adjacent to meandering slots 104, as seen most clearly in FIG. 1B. Conductive elements 114, extending between a radiating element formed by conical radiating element 106 and a ground plane formed by ground region 102, may be functional as impedance matching elements in antenna 100, thereby allowing a height of conical radiating element 106 to be reduced. In the absence of conductive elements 114, conical radiating element 106 would be required to have a greater height in order to achieve desired radiation efficiency and bandwidth.

Antenna 100 may include four conductive elements 114 spaced at generally equal intervals along a circumference of base 108. Conductive elements 114 may be embodied as bent strip-like elements, as seen in the case of a first, a second and a third conductive element 116. Alternatively, one or more of conductive elements 114 may be embodied as a wire, as seen in the case of a fourth conductive element 118, seen most clearly in FIG. 1C. It is appreciated, however, that such an arrangement of conductive elements 114 is exemplary only and that antenna 100 may include various numbers and configurations of conductive elements 114, distributed in accordance with the matching requirements of the antenna. Conical radiating element 106 may be formed as unitary structure including conductive elements 114. Alternatively, conductive elements 114 may be formed as separate elements, connected to conical radiating element 106.

As a result of the inclusion of meandering slots 104 in ground region 102, disk-shaped radiating element 112 and conductive elements 114 in antenna 100, as has been detailed above, antenna 100 may be formed as an extremely low-profile antenna, particularly preferably having a height of less than or equal to 25 mm, wherein the height of the antenna corresponds to the distance between ground region 102 and base 108.

Figure 1D:
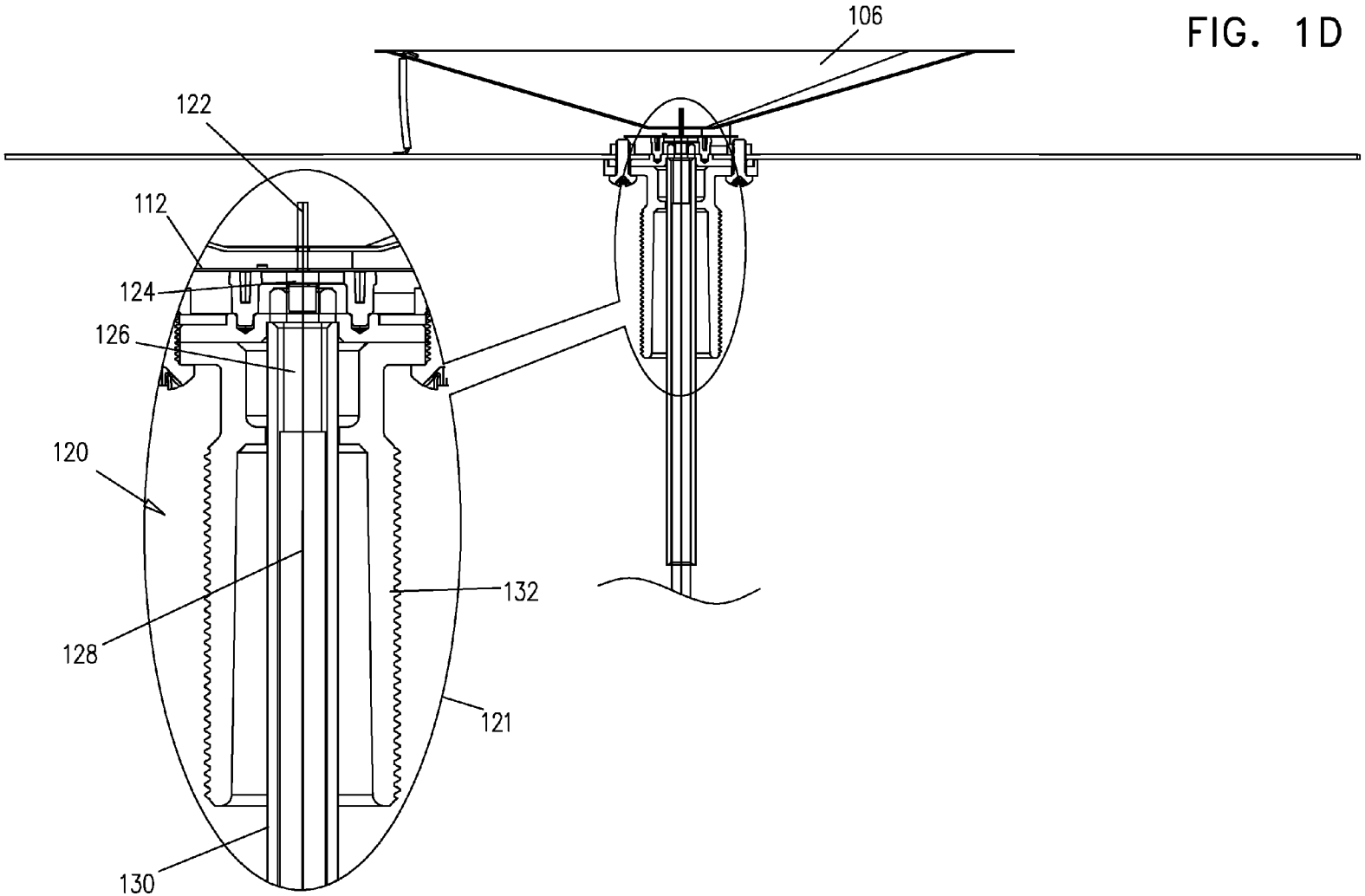
Figure 2A:
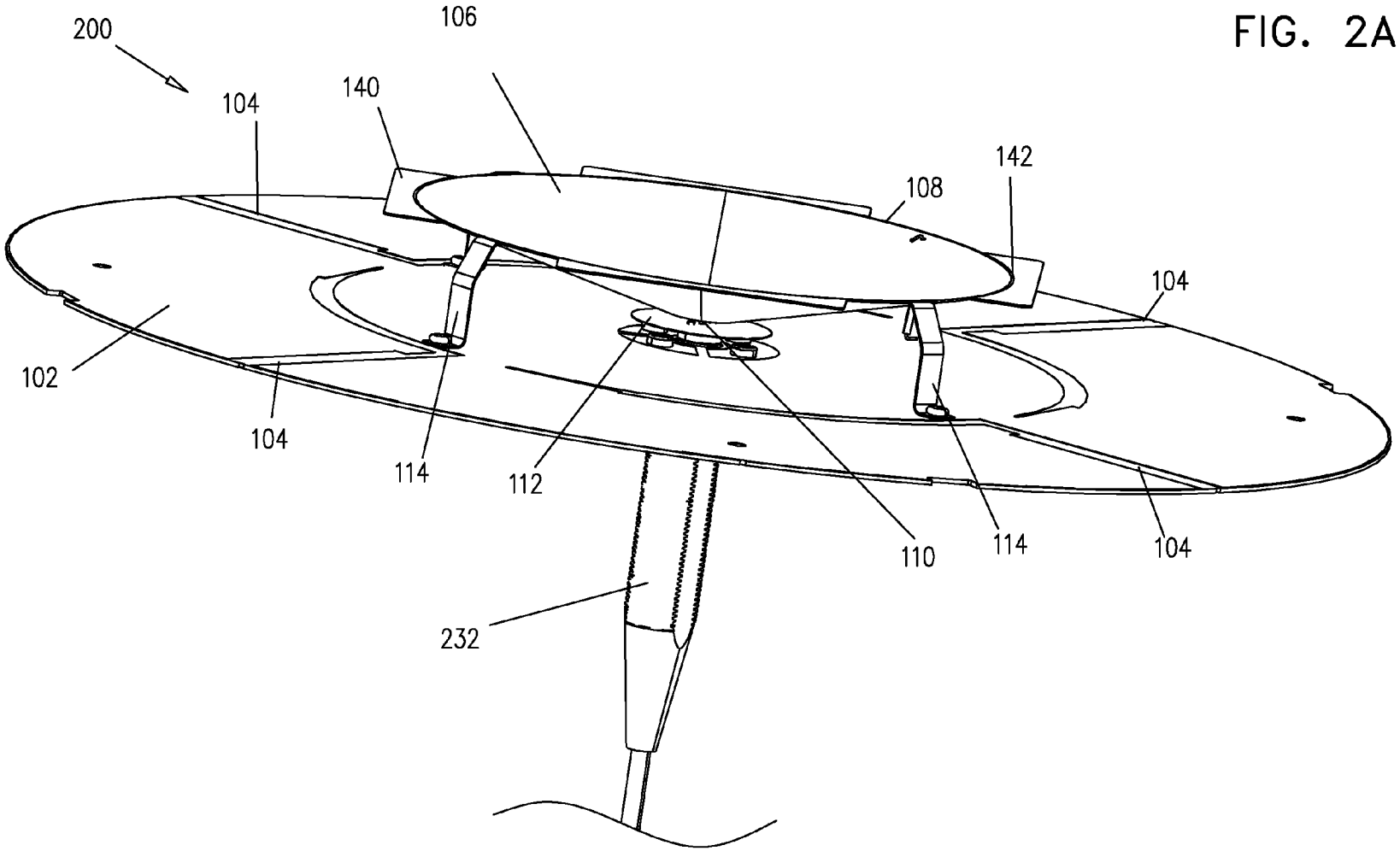
FIGS. 2A, 2B, 2C and 2D are simplified respective perspective, top, side and cross-sectional side view illustrations of an antenna constructed and operative in accordance with another preferred embodiment of the present invention.
Figure 2B:
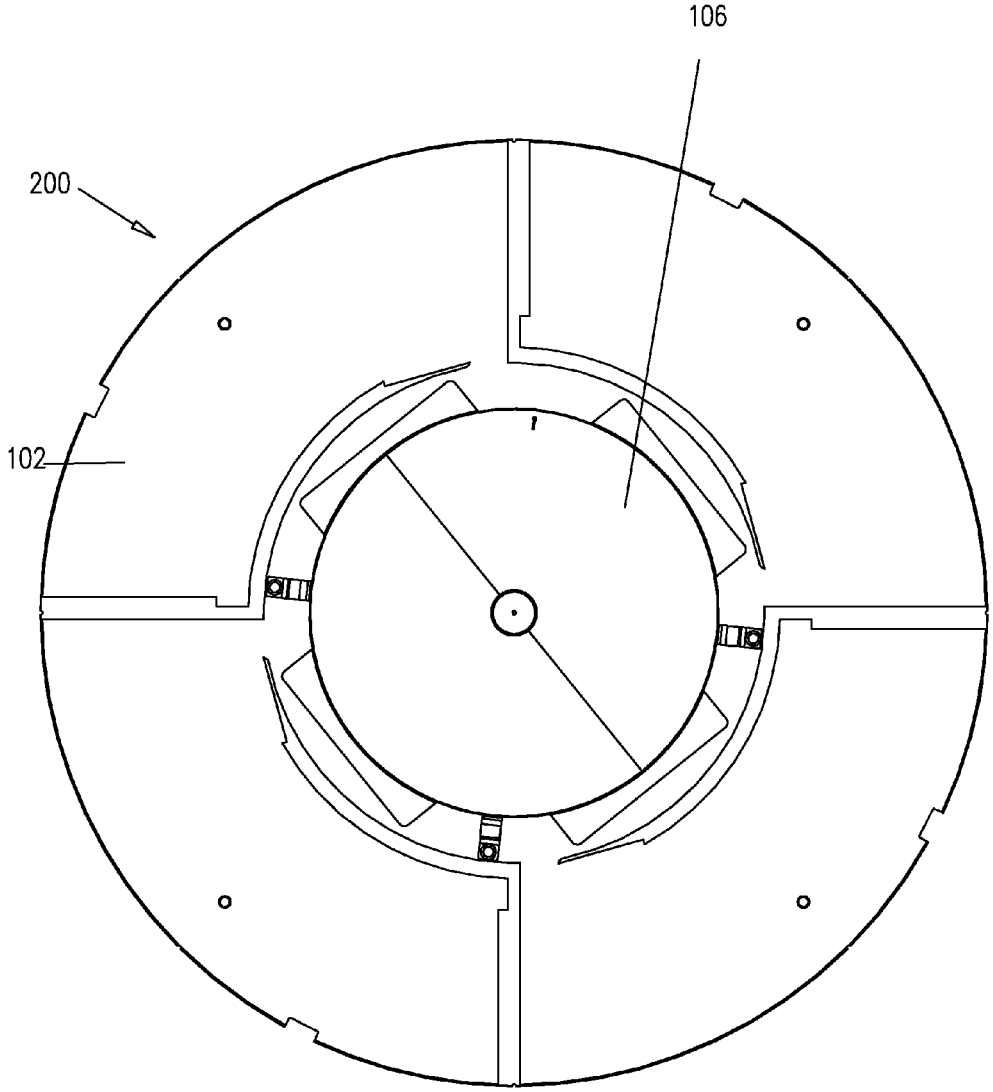
Figure 2C:
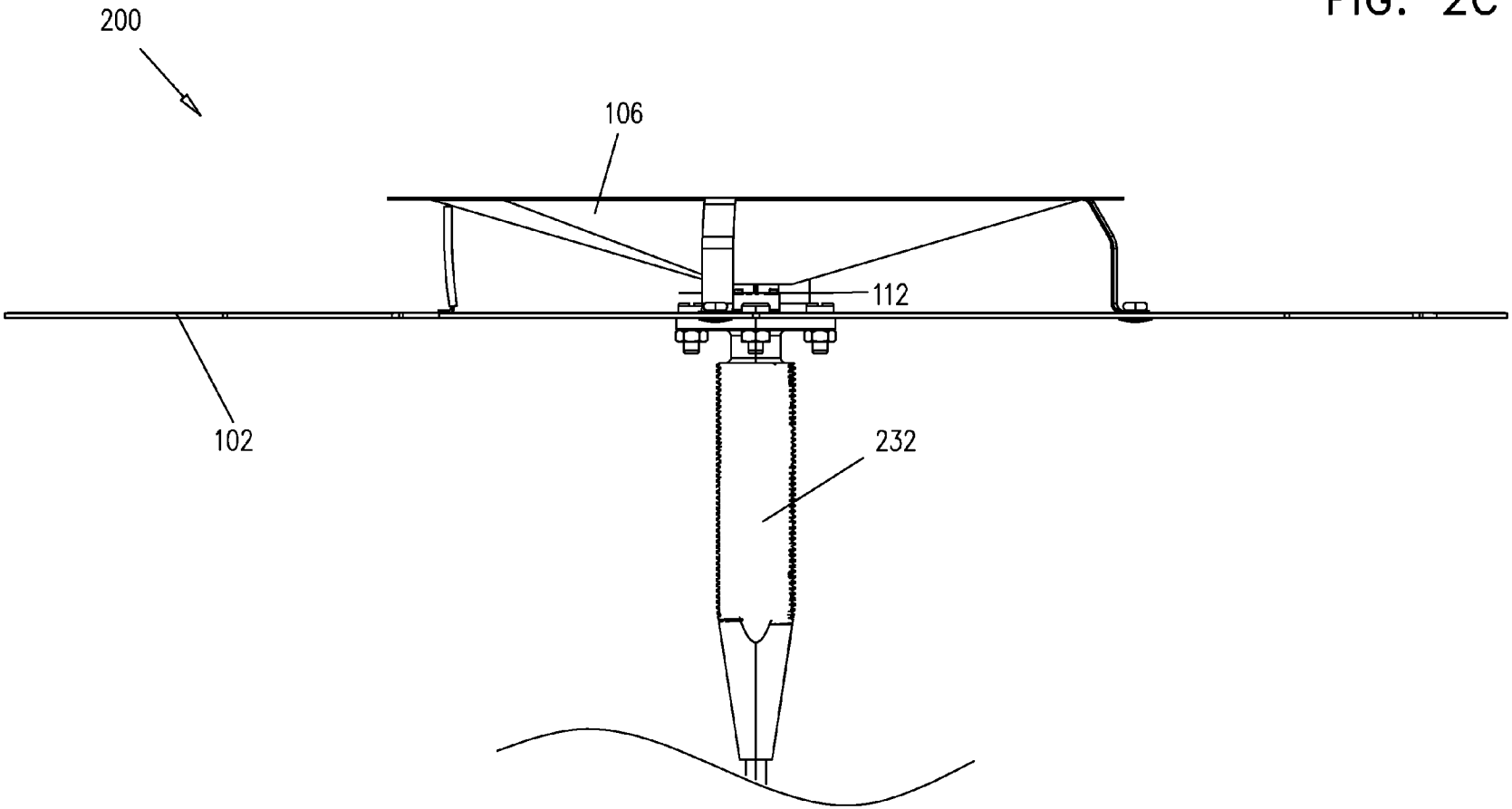
Figure 2D:
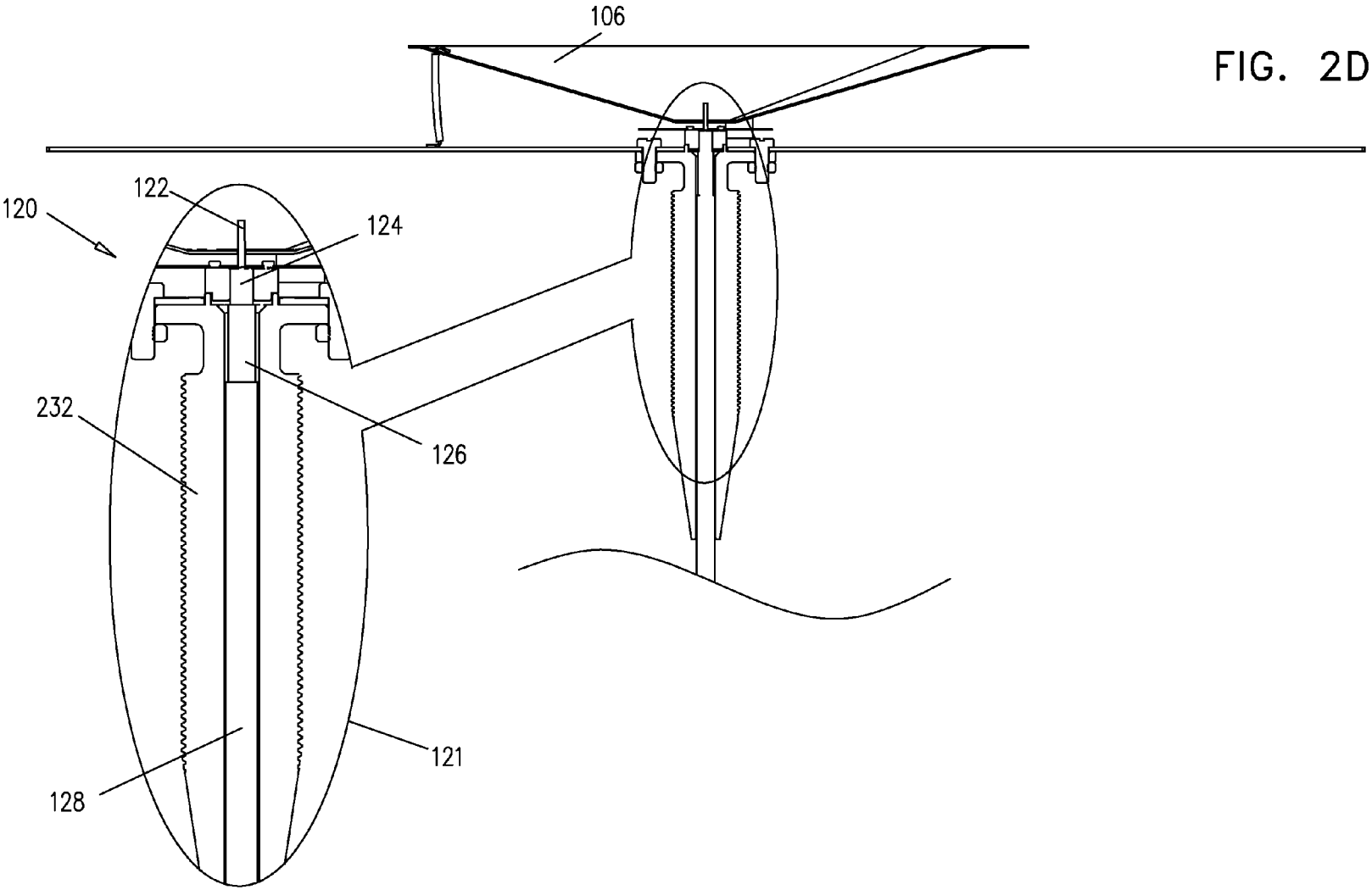

Antenna 100 preferably receives/transmits a radio-frequency (RF) signal by way of a coaxial feed arrangement 120, seen most clearly at an enlargement 121 in FIG. 1D. Coaxial feed arrangement 120 preferably comprises a central core feed element 122 housed by a dielectric insulator 124, which dielectric insulator 124 is in turn enclosed by a grounded metallic shield 126. An outer insulator layer 128 preferably surrounds grounded metallic shield 126 and may be at least partially enclosed by a dielectric jacket 130. A non-conductive holder 132 may be circumferentially disposed on an upper section of dielectric jacket 130 abutting ground region 102, so as to support antenna 100. Central core feed element 122 preferably extends from disk-shaped radiating element 112 through conical radiating element 106 and is preferably galvanically connected both to disk-shaped radiating element 112 and to conical radiating element 106. Central core feed element 122 may be soldered or otherwise galvanically connected to conical radiating element 106. Conical radiating element 106 is thus galvanically connected to disk-shaped radiating element 112. In addition, capacitive coupling exists between conical radiating element 106 and disk-shaped radiating element 112 due to the distance therebetween. Disk-shaped radiating element 112 thus serves as a distributed feed element for conical radiating element 106, thereby advantageously improving the radiating properties of conical radiating element 106. Grounded metallic shield 126 preferably galvanically contacts ground region 102.

In operation of antenna 100, conical radiating element 106 in combination with disk-shaped radiating element 112 and ground region 102 preferably radiates omni-directionally in a low-frequency band spanning approximately 700-960 MHz. The presence of meandering slots 104 in ground region 102 serves to increase the electrical length of ground region 102 by forcing currents to travel around the edges of meandering slots 104, thereby improving the low-frequency performance of antenna 100. Additionally, conical radiating 106 in combination with disk-shaped radiating element 112 preferably radiates omni-directionally in a high-frequency band spanning approximately 1710-2700 MHz. It is appreciated that the provision of the above-delineated broadband multiband frequency ranges of operation by an antenna having a height of only approximately 25 mm is extremely advantageous and is in contrast to conventional broadband multiband antennas, which antennas are typically much larger.

The voltage standing wave ratio (VSWR) of antenna 100 in its low-frequency band of operation is preferably improved way of the addition of a plurality of winged protrusions 140 preferably extending outwards from the base 108 of conical radiating element 106. The presence of protrusions 140 serves to improve the directionality of the low-frequency radiation of antenna 100. A preferable configuration of protrusions 140 is seen most clearly in FIG. 1B, in which winged protrusions 140 are seen to comprise quasi-rectangular elements having a concave inner edge 142. It is appreciated, however, that protrusions 140 may be configured as having a variety of shapes, depending on the desired VSWR of antenna 100 in its low-frequency band of operation.

The VSWR of antenna 100 in its low-frequency band of operation may be further improved by way of the replacement of dielectric jacket 130 and non-conductive holder 132 by a single conductive structure, as shown for an antenna 200 illustrated in FIGS. 2A-2D. Antenna 200 may generally resemble antenna 100 in relevant aspects thereof, with the exception of in the replacement of dielectric jacket 130 and non-conductive holder 132 of antenna 100 by an elongate conductive holder 232 in antenna 200, as seen most clearly in FIGS. 2A and 2D. Conductive holder 232 is preferably circumferentially disposed around an upper section of outer insulator layer 128 so as to abut ground region 102 and may be galvanically connected to ground region 102. Conductive holder 232 is preferably functional to reduce undesirable currents along metallic shield 126 and to increase the effective surface area of ground region 102 by forming an additional portion thereof, thereby improving the VSWR in the low-frequency band of operation of antenna 200. Various parameters of conductive holder 232 may be adjusted in order to modify of the low-frequency band operating characteristics of antenna 200, including a length and circumference thereof.

The VSWR of antennas 100 and 200 in the respective high-frequency bands of operation thereof may be influenced by a diameter of disk-shaped element 112 and by a distance between disk-shaped element 112 and ground region 102. It has been found that the VSWR of antennas 100 and 200 in the high-frequency bands of operation thereof is optimized when disk-shaped radiating element 112 is formed having a diameter in the range of 20-25 mm and particularly preferably of approximately mm and is separated from ground region 102 by a distance in the range of 3-5 mm and 20 particularly preferably of approximately 4.7 mm. It is appreciated, however, that the VSWR of antennas 100 and 200 in the high-frequency bands of operation thereof may be adjusted by way of modification of the above-mentioned parameters associated with disk-shaped radiating element 112, in accordance with the operating requirements of the antennas.

Reference is now made to FIGS. 3A, 3B, 3C and 3D, which are simplified respective perspective, top, side and cross-sectional side view illustrations of an antenna constructed and operative in accordance with a further preferred embodiment of the present invention.

As seen in FIGS. 3A-3D, there is provided an antenna 300. Antenna 300 preferably includes a generally planar ground region 302 having a plurality of meandering slots 304 formed therein. A generally conical radiating element 306 is preferably supported on ground region 302 and spaced apart therefrom. Conical radiating element 306 preferably has a base 308 and an apex 310 and is preferably disposed in spaced relation to ground region 302 such that apex 310 is proximal to ground region 302 and base 308 is distal therefrom, as seen most clearly in FIGS. 3A and 3C.

A generally flat disk-shaped radiating element 312 is preferably disposed between apex 310 of conical radiating element 306 and ground region 302. Disk-shaped radiating element 312 preferably has a dual-function in antenna 300, both as a feed element, for feeding conical radiating element 306 and as a radiating element in its own right, as will be detailed henceforth. The generally flat configuration of disk-shaped radiating element 312 allows disk-shaped radiating element 312 to perform its feeding and radiating functions with minimal contribution to a height of antenna 300, hence rendering antenna 300 extremely compact.

The compact, low-profile configuration of antenna 300 is further facilitated by way of the preferable inclusion therein of a multiplicity of conductive elements 314, preferably supporting conical radiating element 306 on ground region 302 and extending between conical radiating element 306 and ground region 302. Conductive elements 314 may galvanically connect conical radiating element 306 to ground region 302. Conductive elements 314 may emerge from base 308 and may terminate at a location on ground region 302 immediately adjacent to meandering slots 304, as seen most clearly in FIG. 3B. Conductive elements 314, extending between a radiating element formed by conical radiating element 306 and a ground plane formed by ground region 302, may be functional as impedance matching elements in antenna 300, thereby allowing a height of conical radiating element 306 to be reduced. In the absence of conductive elements 314, conical radiating element 306 would be required to have a greater height in order to achieve desired radiation efficiency and bandwidth.

Antenna 300 preferably includes four conductive elements 314 spaced at generally equal intervals along a circumference of base 308. Conductive elements 314 may be embodied as bent strip-like elements, as seen in the case of a first, a second and a third conductive element 316. Alternatively, one or more of conductive elements 314 may be embodied as a capacitor capacitively coupling conical radiating element 306 to ground region 302, as seen in the case of a fourth conductive element 318 seen most clearly in FIG. 3C. It is appreciated, however, that such an arrangement of conductive elements 314 is exemplary only and that antenna 300 may include various numbers and configurations of conductive elements 314, distributed in accordance with the matching requirements of the antenna. Conical radiating element 306 may be formed as unitary structure including conductive elements 314. Alternatively, conductive elements 314 may be formed as separate elements, connected to conical radiating element 306.

As a result of the inclusion of meandering slots 304 in ground region 302, disk-shaped radiating element 312 and conductive elements 314 in antenna 300, as has been detailed above, antenna 300 may be formed as an extremely low-profile antenna, particularly preferably having a height of less than or equal to 25 mm, wherein the height of the antenna corresponds to the distance between ground region 302 and base 308.

Figure 3A:
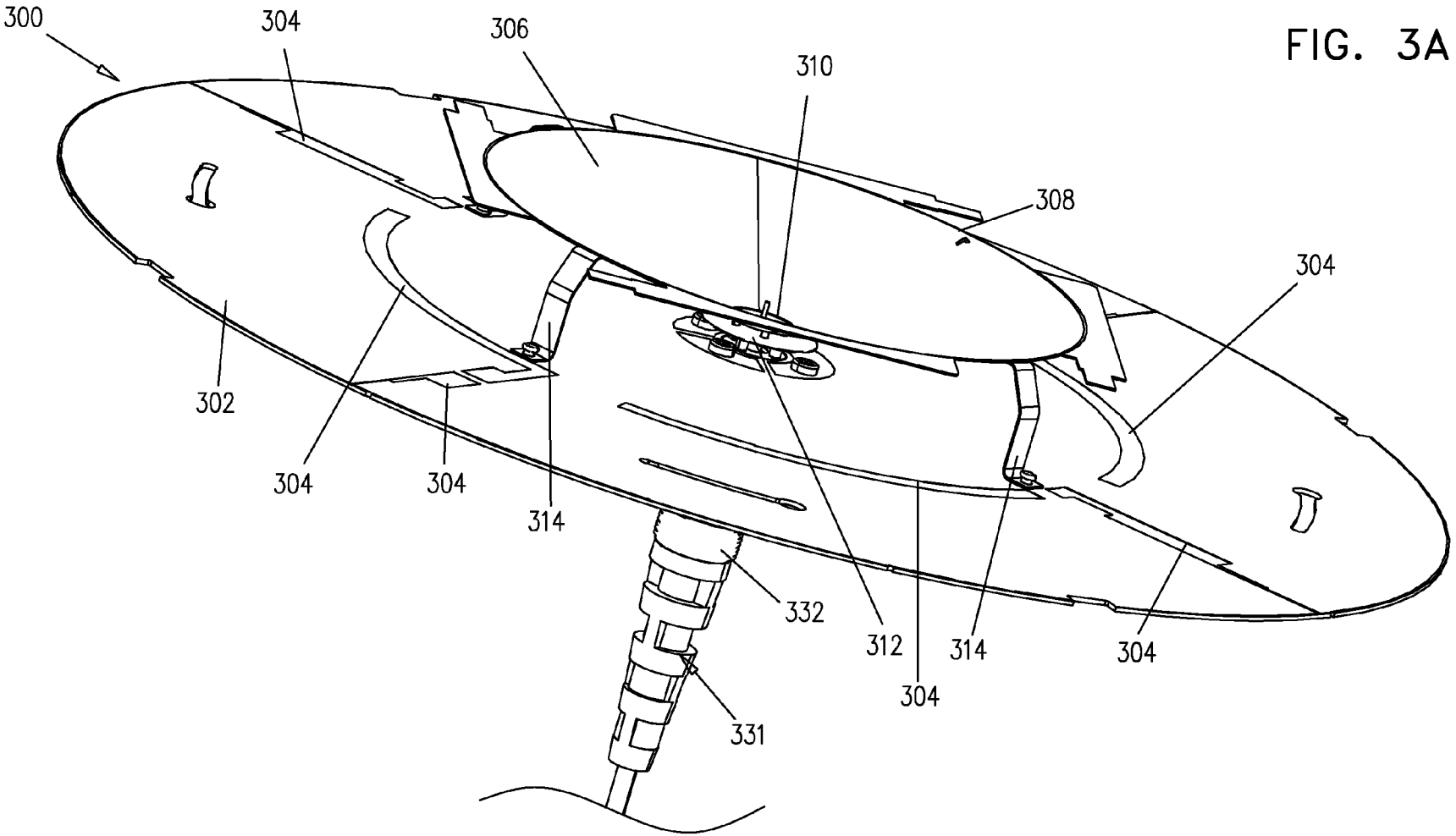
FIGS. 3A, 3B, 3C and 3D are simplified respective perspective, top, side and cross-sectional side view illustrations of an antenna constructed and operative in accordance with a further preferred embodiment of the present invention.
Figure 3B:
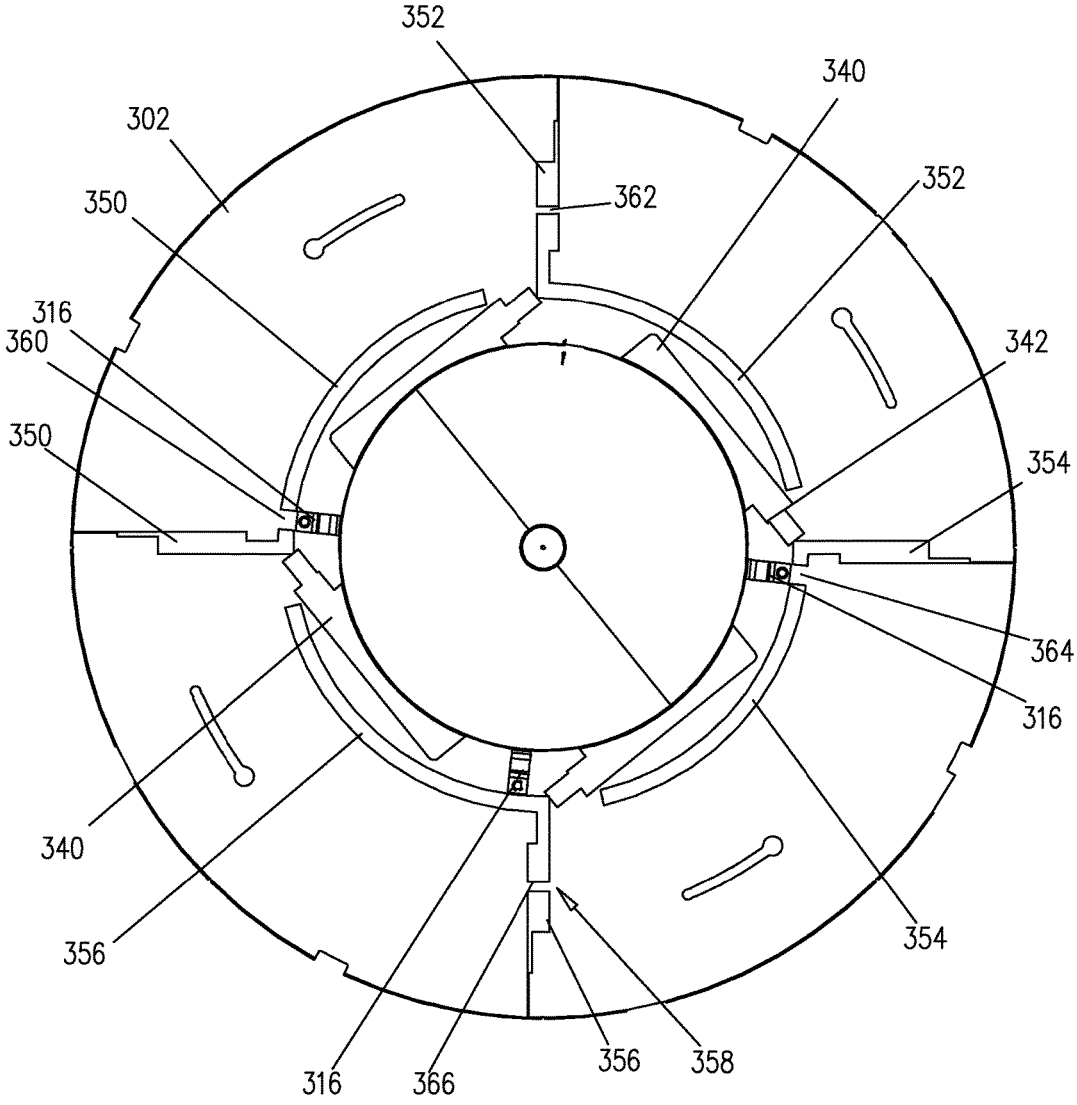
Figure 3C:
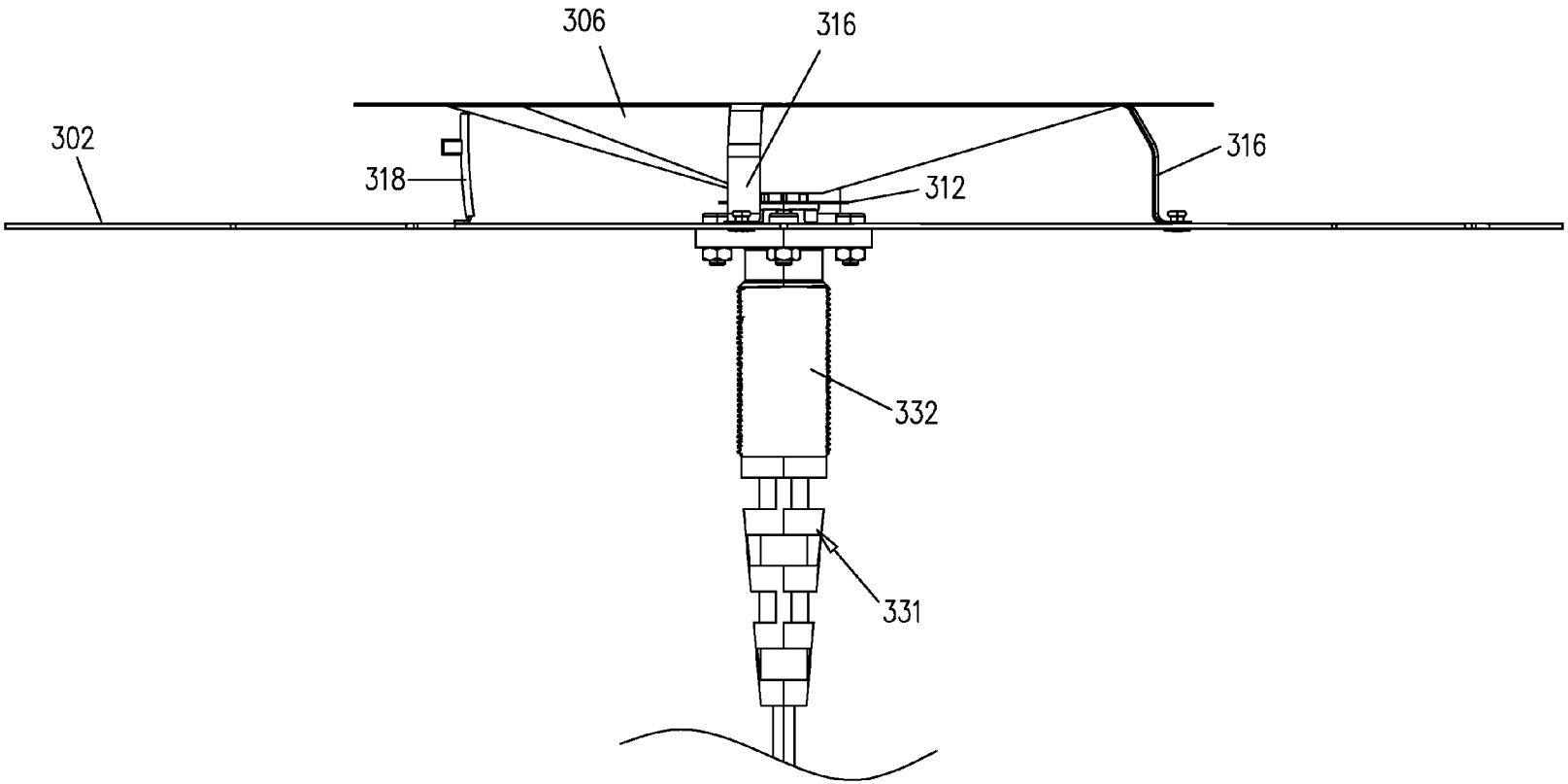
Figure 3D:
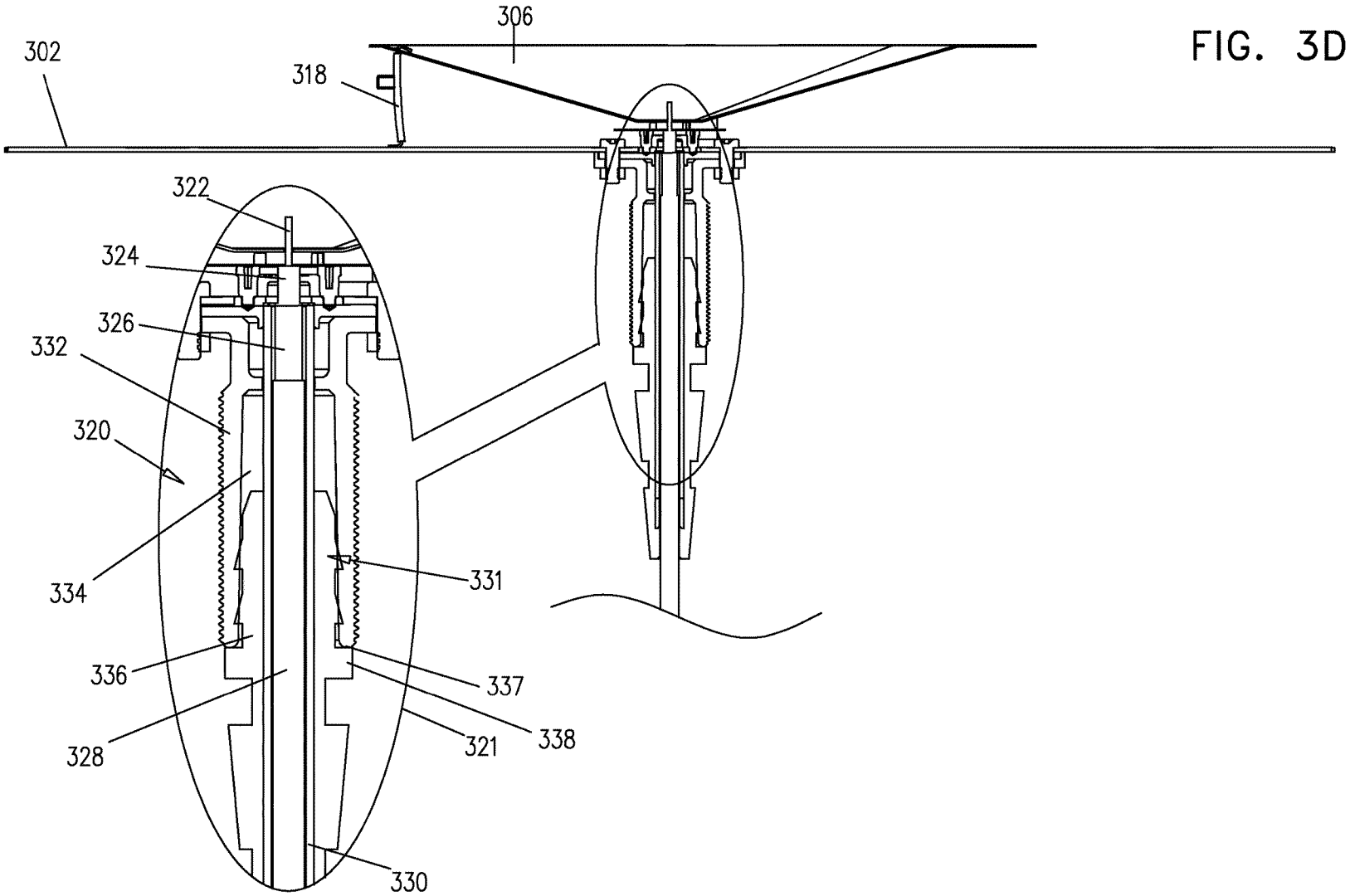

Antenna 300 preferably receives/transmits an RF signal by way of a coaxial feed arrangement 320, seen most clearly at an enlargement 321 in FIG. 3D. Coaxial feed arrangement 320 preferably comprises a central core feed element 322 housed by a dielectric insulator 324, which dielectric insulator 324 is in turn enclosed by a grounded metallic shield 326. An outer insulator layer 328 preferably surrounds grounded metallic shield 326 and may be at least partially enclosed by a dielectric jacket 330. A non-conductive connector portion 331 may be circumferentially disposed so as to completely surround dielectric jacket 330 and extend beyond an end thereof. A non-conductive holder 332 may encircle an upper section of non-conductive connector portion 331 so as to support antenna 300.

Non-conductive connector portion 331 may comprise a first segment 334, disposed proximal to ground region 302, and a second segment 336 partially overlapping with first segment 334 and disposed distal from ground region 302. Non-conductive holder 332 may completely surround and enclose first segment 334 and may have a base 337 adapted to rest on a shoulder 338 of second segment 336. This configuration of coaxial feed arrangement 320 has been found to be extremely economical to manufacture and to have a negligible effect on the radiating properties of antenna 300. It is appreciated, however, that various configurations of coaxial feed arrangement 320 are possible and are included in the scope of the present invention.

Central core feed element 322 preferably extends from disk-shaped radiating element 312 through conical radiating element 306 and is preferably galvanically connected both to disk-shaped radiating element 312 and to conical radiating element 306. Central core feed element 322 may be soldered or otherwise galvanically connected to conical radiating element 306. Conical radiating element 306 is thus galvanically connected to disk-shaped radiating element 312. In addition, capacitive coupling exists between conical radiating element 306 and disk-shaped radiating element 312 due to the distance therebetween. Disk-shaped radiating element 312 thus serves as a distributed feed element for conical radiating element 306, thereby advantageously improving the radiating properties of conical radiating element 306. Grounded metallic shield 326 preferably galvanically contacts ground region 302.

In operation of antenna 300, conical radiating element 306 in combination with disk-shaped radiating element 312 and ground region 302 preferably radiates in a low-frequency band spanning approximately 700-960 MHz. The presence of meandering slots 304 in ground region 302 serves to increase the electrical length of ground region 302 by forcing currents to travel around the edges of meandering slots 304, thereby improving the low-frequency performance of antenna 300. Additionally, conical radiating 306 in combination with disk-shaped radiating element 312 preferably radiates in a high-frequency band spanning approximately 1710-2700 MHz. It is appreciated that the provision of the above-delineated broadband multiband frequency ranges of operation by an antenna having a height of only approximately 25 mm is extremely advantageous and is in contrast to conventional broadband multiband antennas, which antennas are typically much larger.

The VSWR of antenna 300 in its low-frequency band of operation is preferably improved way of the addition of a plurality of winged protrusions 340 preferably extending outwards from the base 308 of conical radiating element 306. The presence of protrusions 340 serves to improve the directionality of the low-frequency radiation of antenna 300. A preferable configuration of protrusions 340 is seen most clearly in FIG. 3B, in which winged protrusions 340 are seen to be formed as asymmetrical turret-like structures having a setback inner edge 342. It is appreciated, however, that protrusions 340 may be configured as having a variety of shapes, depending on the desired VSWR of antenna 300 in its low-frequency band of operation.

The VSWR of antenna 300 in its high-frequency band of operation may be influenced by a diameter of disk-shaped element 312 and by a distance between disk-shaped element 312 and ground region 302. It has been found that the VSWR of antenna 300 in its high-frequency band of operation is optimized when disk-shaped radiating element 312 is formed having a diameter in the range of 20-25 mm and particularly preferably of approximately 25 mm and is separated from ground region 302 by a distance in the range of 3-5 mm and particularly preferably of approximately 4.7 mm. It is appreciated, however, that the VSWR of antenna 300 in its high-frequency band of operation may be adjusted by way of modification of the above-mentioned parameters associated with disk-shaped radiating element 312, in accordance with the operating requirements of antenna 300.

The VSWR of antenna 300 in its low-frequency band of operation may be further improved by a configuration of meandering slots 304. Meandering slots 304 may comprise a first meandering slot 350, a second meandering slot 352, a third meandering slot 354 and a fourth meandering slot 356. The VSWR of antenna 300 may be further improved by way of the formation a plurality of closures 358 along and within slots 304, which closures 358 preferably comprise a first closure 360 formed along first slot 350, a second closure 362 formed along second slot 352, a third closure 364 formed along third slot 354 and a fourth closure 366 formed along fourth slot 356. The formation of closures 358 along and within slots 304 serves to divide each one of slots 304 into two discrete portions and has been found to improve the VSWR of antenna 300. However, the formation of closures 358 along and within slots 304 somewhat distorts the omnidirectional radiation patterns of antenna 300. Thus, the formation of closures 358 in antenna 300 is most desirable in the case where a slight degradation in the omnidirectionality of antenna 300 is not significant.

It will be appreciated by persons skilled in the art that the present invention is not limited by what has been particularly claimed hereinbelow. Rather, the scope of the invention includes various combinations and subcombinations of the features described hereinabove as well as modifications and variations thereof as would occur to persons skilled in the art upon reading the forgoing description with reference to the drawings and which are not in the prior art.

The invention claimed is:

1. An antenna comprising:

a ground region having a plurality of meandering slots formed therein, wherein said ground region comprises generally planar element;

a generally conical radiating element supported on said ground region and spaced apart therefrom, wherein said generally conical radiating element comprises a base and an apex and is disposed such that said apex is proximal to said ground region and said base is distal therefrom;

a generally flat disk-shaped radiating element disposed between said generally conical radiating element and said ground region, said generally flat disk-shaped radiating element feeding said generally conical radiating element; and a multiplicity of conductive elements supporting said generally conical radiating element and extending between said generally conical radiating element and said ground region, wherein said multiplicity of conductive elements emerges from said base of said generally conical radiating element and terminates on said ground region immediately adjacent to said plurality of meandering slots.

2. An antenna according to claim 1, wherein said generally flat disk-shaped radiating element is disposed between said apex and said ground region.

3. An antenna according to claim 1, wherein at least one of said multiplicity of conductive elements forms a galvanic connection between said generally conical radiating element and said ground region.

4. An antenna according to claim 3, wherein at least one of said multiplicity of conductive elements forms a capacitive connection between said generally conical radiating element and said ground region.

5. An antenna according to claim 1, wherein said antenna is fed by a coaxial feed arrangement, said coaxial feed arrangement comprising an inner core feed element and an outer grounded metallic shield, said inner core feed element extending from said generally flat disk-shaped radiating element through said apex of said generally conical radiating element, said outer grounded metallic shield being connected to said ground region.

6. An antenna according to claim 5, wherein said inner core feed element is galvanically connected to said generally flat disk-shaped radiating element and to said generally conical radiating element.

7. An antenna according to claim 5, wherein said antenna also comprises a non-conductive holder abutting said ground region and circumferentially disposed about said coaxial feed arrangement.

8. An antenna according to claim 7, wherein said antenna also comprises a non-conductive connector portion comprising a first segment disposed proximal to said ground region and a second segment partially overlapping with said first segment and disposed distal from said ground region, said non-conductive holder enclosing said first segment and resting on said second segment.

9. An antenna according to claim 5, wherein said antenna also comprises a conductive holder circumferentially disposed about said coaxial feed arrangement, abutting said ground region and galvanically connected thereto, said conductive holder forming a portion of said ground region.

10. An antenna according to claim 1, wherein said antenna operates as a multiband antenna, said generally conical radiating element in combination with said ground region and said generally flat disk-shaped radiating element radiating in a low-frequency band and said generally conical radiating element in combination with said generally flat disk-shaped radiating element radiating in a high-frequency band.

11. An antenna according to claim 10, wherein said low-frequency band lies in a frequency range of 700-960 MHz and said high-frequency band lies in a frequency range of 1710-2700 MHz.

12. An antenna according to claim 11, wherein a height of said antenna is less than or equal to 25 mm.

13. An antenna according to claim 1, and also comprising wing-like protrusions extending from said base of said generally conical radiating element.

14. An antenna according to claim 1, wherein a diameter of said generally flat disk-shaped radiating element is between 20 and 25 mm.

15. An antenna according to claim 14, wherein a separation of said generally flat disk-shaped radiating element from said planar ground region is between 3 and 5 mm.

16. An antenna according to claim 1, wherein each one of said meandering slots comprises a closure formed therein.

* * * * *